United States Patent [19]

Balbinot

[11] Patent Number: 4,999,933

[45] Date of Patent: Mar. 19, 1991

[54] SKI BOOT

[75] Inventor: Renzo Balbinot, Pieve Di Soligo, Italy

[73] Assignee: Lange International S.A., Fribourg, Switzerland

[21] Appl. No.: 463,397

[22] Filed: Jan. 11, 1990

[30] Foreign Application Priority Data

Feb. 1, 1989 [CH] Switzerland ..... 338/89

[51] Int. Cl.[5] ..... A43B 5/04

[52] U.S. Cl. ..... 36/117; 36/120

[58] Field of Search ..... 36/117-121

[56] References Cited

U.S. PATENT DOCUMENTS 4,800,659 1/1989 Marega ..... 36/119
4,809,448 3/1989 Tonel et al. ..... 36/120
4,841,650 6/1989 Dodge et al. ..... 36/120
4,864,745 9/1989 Hensler ..... 36/120

FOREIGN PATENT DOCUMENTS 0252417 1/1988 European Pat. Off. ..... 36/117

*Primary Examiner*—Paul T. Sewell
*Assistant Examiner*—Ted Kavanaugh
*Attorney, Agent, or Firm*—Kane, Dalsimer, Sullivan, Kurucz, Levy, Eisele and Richard

[57] ABSTRACT

The boot comprises a shaft (2) in two parts which are articulated on a lower part (1) by means of two rivets (6). The front part of the shaft consists of two pieces (5, 7) which are mutually assembled exclusively by interlocking and catching, that is to say without the aid of auxiliary means of fixing. This construction makes it possible to eliminate the riveting operations and improves the capacity for enclosing of the leg by the shaft.

8 Claims, 3 Drawing Sheets

SKI BOOT

FIELD OF THE INVENTION

The present invention relates to a ski boot comprising a lower part in the form of a shell, which encloses the foot and the heel, and a shaft which is articulated on the lower part and consists of a rear half-shaft and of a front half-shaft which in turn consists of two pieces, namely a first piece, which is attached to the lower part of the boot and has an indentation in its upper edge opposite the tibia, and a second piece, which is assembled on the first part, outside the latter, and has two transverse parts which are mutually connected on the sides of the shaft by two lateral connection parts, the upper transverse part covering said indentation.

PRIOR ART

Such a boot is known from the document EP-A-0 259 721. The second part of the front shaft is fixed to the first part of the front half-shaft by means of two rivets. The upper transverse part of the second piece of the front half-shaft receives the thrust of the tibia when the leg is bent. As this transverse part is only attached to the shaft laterally, it bends at the time of this thrust and thus gives the boot a certain flexibility. The other transverse part extends essentially parallel to the upper transverse part, at one or two centimeters from this latter, on the first piece of the front half-shaft and it is assembled on the latter by means of two rivets. The assembly of the front half-shaft thus requires two riveting operations. Furthermore, the holes through which the rivets pass create areas of reduced resistance at a point where stresses can be high. Moreover, the rivets create excess thicknesses, reduce the flexibility of the shaft in its part which encloses the leg and are unattractive.

The principal aim of the present invention is to produce a front half-shaft in two pieces which are assembled without rivets.

SUMMARY OF THE INVENTION

The boot according to the invention is one in which the two pieces of the front half-shaft, made of semi-rigid synthetic material, are mutually assembled exclusively by interlocking and catching, that is to say without the aid of auxiliary means of fixing.

The half-shaft which is thus produced has a number of advantages. Not only are the two riveting operations eliminated, but the fixing by interlocking and catching is carried out over broad sections over which the stresses are distributed, which gives the assembly an increased resistance. On the other hand, the absence of rivets gives the half-shaft greater flexibility with regard to its capacity for being wound around the leg and for enclosing the latter. Moreover, the two parts can be made of different materials. The absence of rivets makes it possible to guide a buckle around at the level of the assembly. Lastly, the appearance of the boot is improved.

According to an embodiment of the invention, one of the two pieces has a part in relief which interlocks between the transverse parts and the connection parts of the other piece. The interlocking of the two pieces gives the half-shaft greater resistance in forward bending, which on the other hand makes it possible to reduce the thickness of its first piece, which contributes to increasing its enclosing capacity.

BRIEF DESCRIPTION OF THE DRAWINGS

The attached drawing represents by way of example an embodiment of the invention.

DESCRIPTION OF THE PREFERRED EMBODIMENTS

Figure 1:
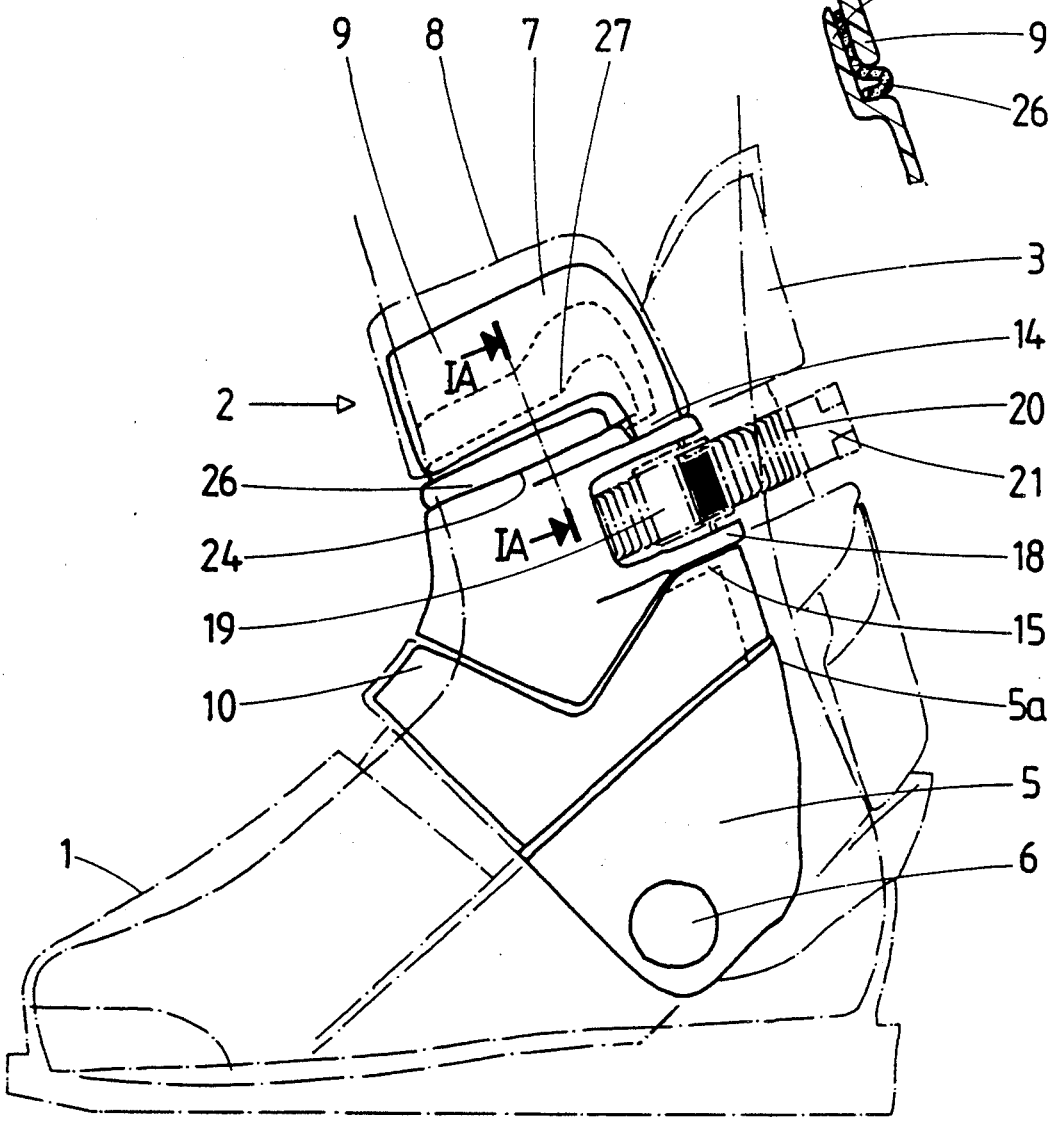
FIG. 1 is a partly schematic view of a boot according to the invention.
Figure 1A:
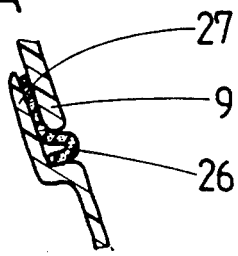
FIG. 1*a* is a detailed sectional view according to IA–IA in FIG. 1.

The boot which is represented in FIG. 1, partially in dot-dash lines, comprises a lower part 1 in the form of a shell, which comprises the sole and encloses the foot and the heel, and a shaft 2 which is articulated on the lower part 1 by means of two rivets 6 and consists of a rear half-shaft, and of a front half-shaft which in turn consists of a first piece 5 and of a second piece 7 which is mounted on the first part 5. The boot contains an innerboot 8 for comfort. The front half-shaft is distinguished from the rest of the boot in the drawing by the fact that it is represented in unbroken lines.

The second piece 7 has an upper transverse part 9 and a lower transverse part 10, which extends over the instep, these two parts being connected by two lateral connection parts 11 and 12. The first piece 5 of the front halfshaft is approximately in the form of a horse saddle extending over the instep and over the front of the ankle. Its upper edge has an indentation 13 opposite the tibia. This piece 5 also has, on each of its rear lateral edges 5*a*, 5*b* respectively, two pairs of notches 14, 15 and 16, 17. Between the notches 14 and 15, the edge 5*a* is prolonged in the form of a part profiled as a channel 18, in which a catch 19 is mounted, which is intended to retain in a manner known per se a serrated strap 20 which forms part of a buckle 21 intended for closing and tightening the boot. Towards the front, the channel opens into a slot in which the serrated strap, which thus passes under the piece 5, engages in a known manner.

Between the other two notches 16 and 17, the edge 5*b* of the piece 5 is prolonged in the form of a tongue 22, to the end of which the buckle 21 is fixed, the tongue 22 and the buckle 21 thus forming a tightening collar. Between the channel 18 and the tongue 22, the piece 5 has a part in relief 23, the upper edge 24 of which constitutes a bearing surface, the role of which is described below.

Figure 2:
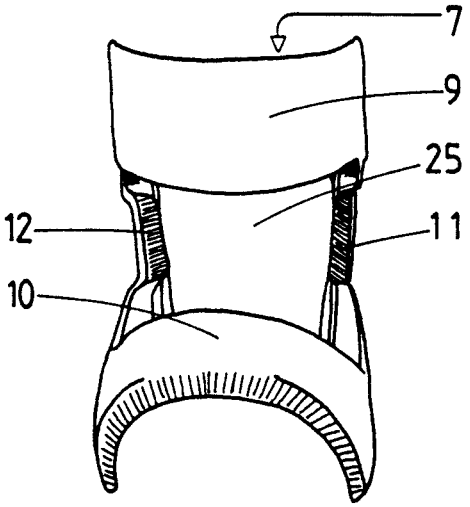
FIG. 2 is a front view of the second piece of the front half-shaft.
Figure 3:
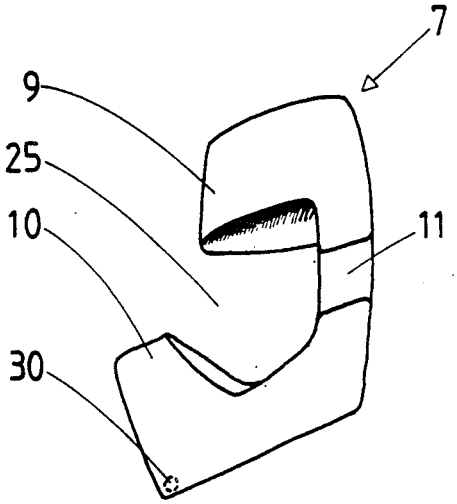
FIG. 3 is a side view of this same second piece of the front half-shaft.
Figure 4:
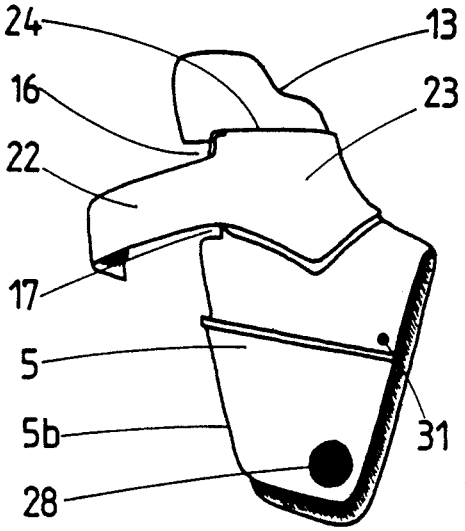
FIG. 4 is a front view of the first piece of the front half-shaft.
Figure 5:
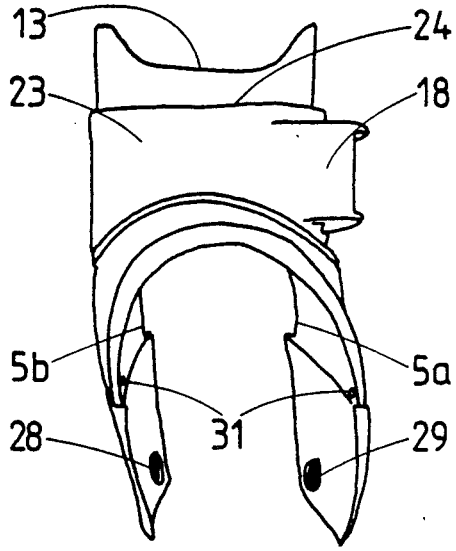
FIG. 5 is a side view of this first piece of the front half-shaft.

The form of the second piece 7 of the front half-shaft can be seen in FIGS. 2 and 3. The two transverse parts 9 and 10 and their connections 11 and 12 surround a large cut-out 25, the shape of which is similar to the form of the projecting part 23 of the part 5, the height of the cut-out 25 being, however, somewhat greater than the height of the part 23 so as to leave a space between the lower edge of the part 9 and the bearing surface 24 of the part 23. In this space, the folded edge 26 of a strip 27 made of flexible material is arranged, which extends between the upper part of the part 5 and the part 9 and is held in place by pinching between the two pieces of the front half-shaft, without other auxiliary means of fixing. The fold 26 is open and its elasticity constitutes an elastic stop for the part 9 when it bends under the pressure of the tibia.

The lateral connection parts 11 and 12 of the second piece of the front half-shaft have, seen from the front and from the rear, a shallow U-shaped profile directed towards the inside of the boot.

The first piece 5 of the front half-shaft has, moreover, two holes 28 and 29 which are intended for the passage of the articulation rivets 6.

Figure 6:
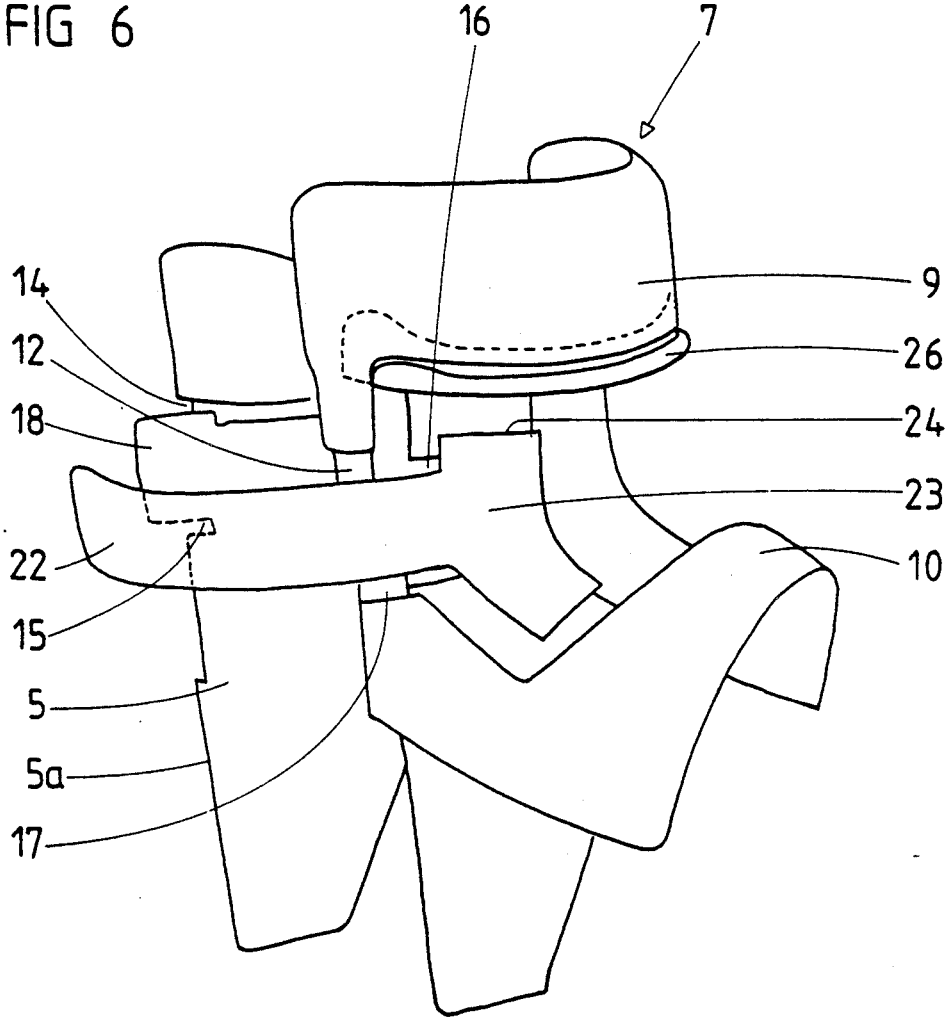
FIG. 6 shows the two pieces represented in FIGS. 2 to 5 in the course of assembly.

The two pieces 5 and 7 of the front half-shaft are assembled with one another by interlocking and catching. This is possible by making use of the capacity for elastic deformation of the semi-rigid synthetic material from which these two pieces are made. The material used is, for example, polyurethane or polyamide, or another semi-rigid material which has a similar capacity for deformation The assembly process is described with reference to FIG. 6.

First of all, the strip of rubber 27 is placed on the edge of the upper transverse part 9 and then, holding the piece 7 with the strip 27 in the left hand, the piece 5 is taken in the right hand and the tongue 22 is introduced into the cut-out 25 from the rear of the piece 7. This tongue 22 is guided across the profiled part 12 of the piece 7, the piece 5 being at the same time turned upon itself in such a manner that it comes to rest in and against the piece 7. The profiled part 12 comes to engage in the notches 16 and 17, between the tongue 22 and the parts of the piece 5 situated above and below the part in relief 23. This part in relief 23 comes to interlock in the cut-out 25 of the piece 7, the bearing surface 24 coming to be situated below the fold 26 of the strip 27. In order to complete assembly, the lateral connection part 11 is forced, by being deformed, to pass over the the rigid end of the profiled channel 18. The part 11 automatically comes to engage in the notches 14 and 15, under the channel 18. The two pieces thus assembled are held together perfectly.

The interlocking is completed by studs 30 which are provided on the piece 7 and come to interlock in holes 31 provided on the piece 5.

The interlocking of the two pieces 5 and 7 gives the front half-shaft excellent performance in bending and twisting and makes it possible to use relatively thin pieces. The absence of rivets and the use of thin pieces has, on the other hand, the effect of increasing the flexibility with regard to the enclosing of the leg.

Figure 7:
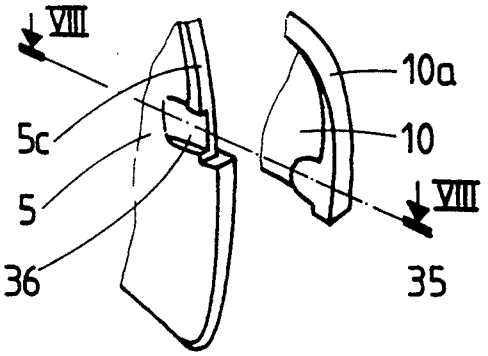
FIG. 7 is an exploded view which illustrates another means of fixing the lower parts of the two pieces of the front half-shaft together.
Figure 8:
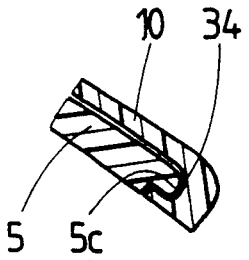
FIG. 8 is a sectional view according to VIII—VIII in FIG. 7.

FIGS. 7 and 8 represent another means of mutually fixing the lower parts of the pieces 5 and 7. The lower front edge 10*a* of the piece 7 is folded towards the inside at its ends and the fold 34 thus formed comes to catch on the lower front edge 5*c* of the piece 5. The folded parts 35 come, moreover, to interlock in notches 36 of the edge 5*c* which lock them laterally.

I claim:

1. A ski boot comprising a lower part (1) in the form of a shell, which encloses the foot and the heel, and a shaft (2) which is articulated on the lower part and consists of a rear half-shaft (3) and of a front halfshaft which in turn consists of two pieces (5, 7), namely a first piece (5), which is attached to the lower part of the boot and has an indentation (13) in its upper edge opposite the tibia, and a second piece (7), which is assembled on the first part, outside the latter, and has two transverse parts (9, 10) which are mutually connected on the sides of the shaft by two lateral connection parts (11, 12), an upper transverse part being spaced vertically above a lower transverse part, the upper transverse part (9) covering said indentation, in which the two pieces (5, 7) of the front half-shaft, made of semi-rigid synthetic material, are mutually assembled exclusively by interlocking and catching, that is to say without the aid of auxiliary means of fixing.

2. The boot as claimed in claim 1, in which the first part (5) of the front half-shaft has, on each of its rear lateral edges, at the level of the lateral connection parts of the second part, two notches (14, 15, 16, 17), in which said lateral connection parts (11, 12) of the second part are engaged, the first and second parts having, in section, conjugate profiles at this point in order to permit the interlocking of these two profiles and the engagement of said lateral connection parts in said notches.

3. The boot as claimed in claim 2, in which the lower transverse part (10) of the second piece (7) of the front half-shaft extends over the instep and in which the first piece (5) of the front half-shaft has a median part in relief (23) which interlocks in the second piece (7), between its transverse parts and its lateral parts.

4. The boot as claimed in claim 3, in which the upper side of said part in relief (23) constitutes a bearing surface (24) which extends transversely essentially parallel to the lower edge of the upper transverse part (9) of the second piece (7) of the front half-shaft and in which an elastic piece (26) is arranged between said bearing edge and said lower edge.

5. The boot as claimed in claim 4, in which the elastic piece (26) is constituted by an open fold formed in the lower part of a strip of flexible material (27) pinched between the first and the second pieces of the front half-shaft.

6. The boot as claimed in claim 3, in which the first piece (5) of the front half-shaft is formed in one piece with a tongue (22) which prolongs one of its lateral edges (5*b*) between two notches (16, 17), this tongue being provided with a tightening buckle which comprises a serrated strap which interacts with a catch mounted in a channel (18) which prolongs between two notches (14, 15) the other lateral edge (5*a*) of the first piece of the front half-shaft.

7. The boot as claimed in claim 3, in which the lower transverse part (10) of the second piece of the front half-shaft is, moreover, fixed to the first piece (5) by two studs (30) which are engaged in two holes (31) of the first piece.

8. The boot as claimed in claim 3, in which the lower front edge (10*a*) of the lower transverse part (10) of the second piece of the front half-shaft is folded (34), at least close to its ends, and comes to catch on the lower front edge (5*c*) of said first piece (5).

* * * * *